US005351830A

United States Patent [19]

Bender et al.

[11] Patent Number: 5,351,830

[45] Date of Patent: Oct. 4, 1994

[54] PACKAGE HAVING A VACUUM ACTUATED CONFORMAL PACKING NEST

[75] Inventors: Stephen Bender, Fort Lee, N.J.; Douglas J. Montgomery, Trumbull, Conn.

[73] Assignee: Ambico, a division of Recoton, Corporation, Long Island City, N.Y.

[21] Appl. No.: 888,880

[22] Filed: May 26, 1992

[51] Int. Cl.[5] ..... B65D 81/20; B65D 81/02

[52] U.S. Cl. ..... 206/524.8; 206/522; 206/591; 206/592; 206/584

[58] Field of Search ..... 206/524.8, 522, 591–594, 206/584, 524, 523

[56] References Cited

U.S. PATENT DOCUMENTS

| | | | |
|---|---|---|---|
| D. 235,929 | 7/1975 | Thompson . | |
| D. 258,611 | 3/1981 | Baturin | D24/64 |
| D. 258,612 | 3/1981 | Baturin | D24/64 |
| D. 261,430 | 10/1981 | Baturin | D24/64 |
| 2,488,922 | 11/1949 | Mead | 206/524.8 X |
| 2,638,263 | 5/1953 | Jesnig | 206/524.8 X |
| 3,338,237 | 8/1967 | Sconce | 128/87 |
| 3,419,134 | 12/1968 | Fitts | 206/522 X |
| 3,515,267 | 6/1970 | Rocco et al. | 206/584 |
| 3,690,903 | 1/1970 | Thomka | 206/524.8 X |
| 3,745,998 | 7/1973 | Rose | 128/89 |
| 3,811,434 | 5/1974 | Jacobson et al. | 128/89 |
| 4,157,713 | 6/1979 | Clarey | 128/87 |
| 4,306,549 | 12/1981 | Canie | 128/90 |
| 4,640,080 | 2/1987 | Wright | 53/449 |
| 5,080,155 | 1/1992 | Crozier | 206/524.8 X |

FOREIGN PATENT DOCUMENTS

| | | | |
|---|---|---|---|
| 2659299 | 9/1991 | France | 206/584 |
| 0308775 | 12/1989 | Japan | 206/522 |

OTHER PUBLICATIONS

Page from British photography catalog.
Label for Vacuum Vari-Cushion.
Photo of Vacuum Vari-Cushion.

*Primary Examiner*—Paul T. Sewell
*Assistant Examiner*—Ted Kavanaugh
*Attorney, Agent, or Firm*—F. Eugene Davis, IV

[57] ABSTRACT

A sealed bag of a pliable multi-layered barrier film substantially impervious to air is partially filled with generally spherically closed cell foam plastic particles deformable under a pressure of less than about 0.2 atmospheres. A bag for use in a typical camera is typically 2 to 3 inches wider and longer than the inside of the case and filled with particles from about 1/16 to ¼ of an inch in diameter. When flattened uniformly, the bag with the particles inside is about ½ an inch in thickness. The bag is placed inside a camera case or the like of smaller dimensions than the bag, e.g. 14×6 inches when the pressure in the bag is atmospheric and relieved through an air tube. One or more objects are then depressed into the upper surface of the bag which deforms about them until about a single layer of particles is underneath the object and the particles surround the objects up to about an inch or an inch and a half in depth. A hand operated pump is provided for attachment to the air tube so that the air may be evacuated from the bag to a pressure in the bag of somewhat more than 0.8 atmospheres. The bag and particles then become rigid in the shape formed about the object. The tube is then sealed by a clamp or the like and the nest remains rigid for many months.

18 Claims, 8 Drawing Sheets

PACKAGE HAVING A VACUUM ACTUATED CONFORMAL PACKING NEST

TECHNICAL FIELD

This invention relates to vacuum-actuated conformal packing nests. More particularly, it relates to reconfigurable conformal packing nests and a method of using the same. The nests have particular application to cases for cameras and accessories, and electronics, and for other delicate objects, as well as to reuseable shipping containers.

BACKGROUND ART

For many years, users of photographic and video camera equipment and accessories and other delicate objects have created "nests" to hold and protect the objects in portable carrying cases by cutting holes or recesses in sheets or blocks of foam elastomers or plastics to fit the particular objects to be stored and protected.

These methods have two serious shortcomings:

1. The manual skills required to achieve a satisfactory fit to the sometimes complex shapes.
2. The needs and configurations desired may frequently change, requiring the purchase of new materials and re-cutting and re-fitting for the new use.

In recent years it has been a common practice to ship delicate articles in "nests" of resilient or crushable material such as plastic foam either premolded to conform to the shape of the object or using "foam-in-place" methods. These methods have served well when used for production quantities of fixed product configurations or for one-time shipment of objects of quite variable shape.

There has long been a need to create a new packing method which can be used with little user skill and training to produce a nesting system which conforms easily to the shape of the objects to be stored or shipped and which can be readily re-formed and configured to fit a different combination of objects and shapes.

DISCLOSURE OF THE INVENTION

A packing nest according to the invention generally comprises a sealed container formed of material substantially impervious to air. At least the upper surface of the nest is pliable so that it may be deformed to encompass the lower portion of an object to be nested. The container contains rounded surface particles which are deformable under a pressure of less than about ½ atmospheres, and preferably less than about 0.2 atmospheres. A passageway for air into and out of the container is provided as well as means for closing and opening the passageway.

The sealed container is placed in the bottom of a container such as a camera bag or packing case and the objects to be nested therein are depressed into the upper surface of the sealed container containing the particles until about a single layer is underneath the object and the rest of the particles are heaped up around the objects to be nested. A hand operated air pump is provided with the packing nest which is connected to the passage, which may conveniently be a tube, and air is evacuated to decrease the pressure in the bag and cause the particles to be compressed together to form a rigid nest. The passageway is then closed by clamp or other suitable means and a semi-permanent nest is formed.

When it is desired to change the configuration of the object or objects to be nested, the passageway is opened letting air into the nest and the process is repeated to form a new nest configuration.

OBJECTS OF THE INVENTION

It is therefore an object of the invention to provide a reconfigurable conformal nest and packaging method using the same.

Another object of the invention is to provide a vacuum-actuated conformal packing nest.

A further object of the invention is to provide such a packing nest which provides resilient protection for the objects nested.

A still further object of the invention is to provide such a packing nest which is inexpensive to manufacture and convenient to use.

Other objects of the invention will in part be obvious and will in part appear hereinafter.

The invention accordingly comprises an article of manufacture possessing the features, properties, and the relation of elements which will be exemplified in the articles herein described; and a method comprising the several steps and the relation of one or more of such steps with respect to each of the others which will be exemplified in the method herein described. The scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

The same reference characters refer to the same elements throughout the several views of the drawings.

BEST MODE FOR CARRYING OUT THE INVENTION

Figure 1:
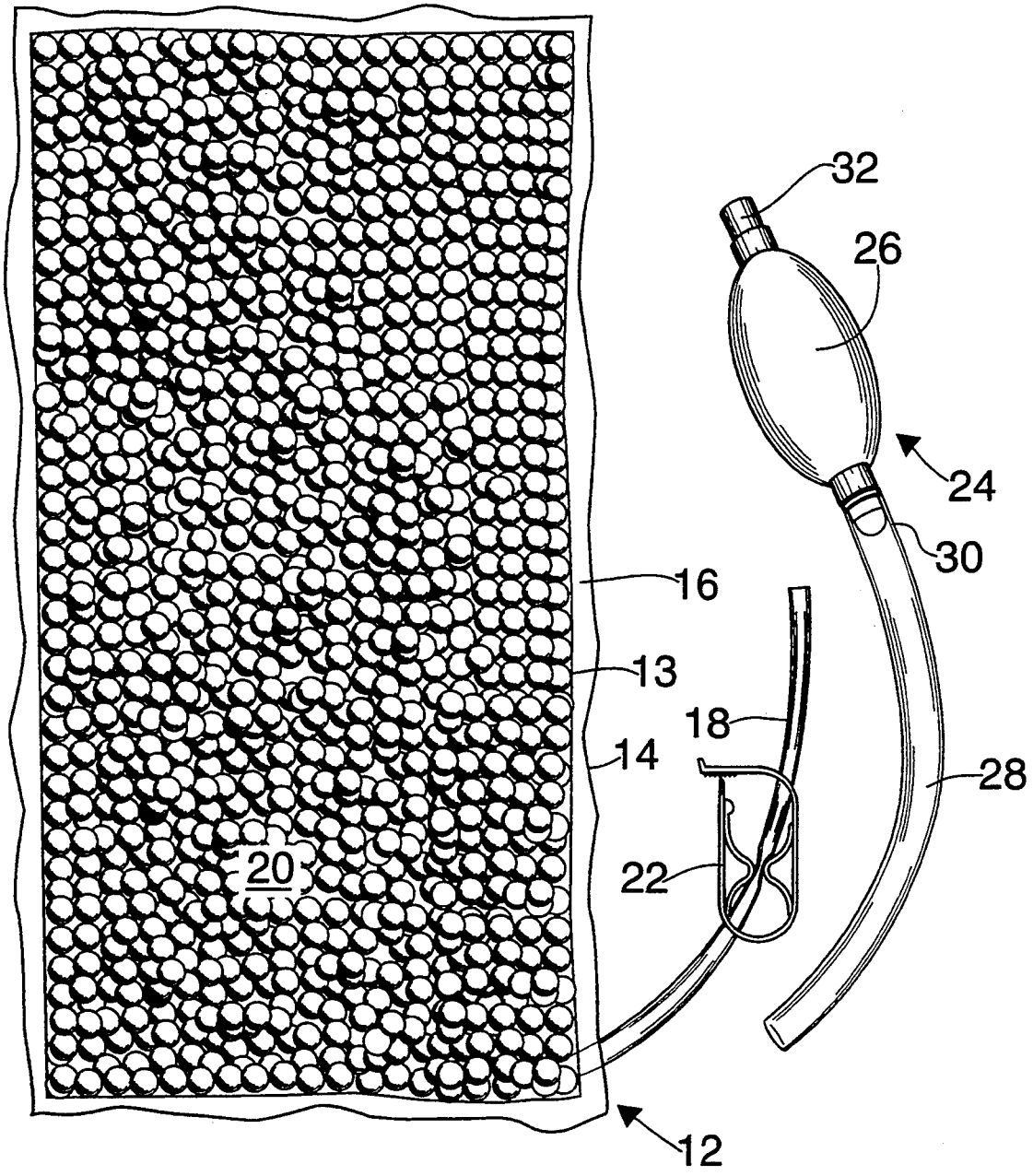
FIG. 1 is a top view of a packing nest and associated pump according to the invention.

Now referring to FIG. 1, a packing nest according to the invention, is generally indicated at 12. It comprises a sheet of pliable plastic material 14 folded over at the bottom and heat sealed at 16 along its periphery. A hollow tube 18 passes through the heat seal and allows for the entrance and exit of air into the sealed nest 12. The nest, when flattened, as shown in FIG. 1 is filled to about ½ inch in thickness with foam plastic spheres 20. The plastic tube 18 may be opened or closed by clamp 22. A hand operated air pump is generally indicated at 24. It comprises a bulb 26 and tube 28, the inner diameter of which fits snugly over the outer diameter of tube 18, so that when the bulb 24 is operated, air may be evacuated from the nest 12.

Figure 2:
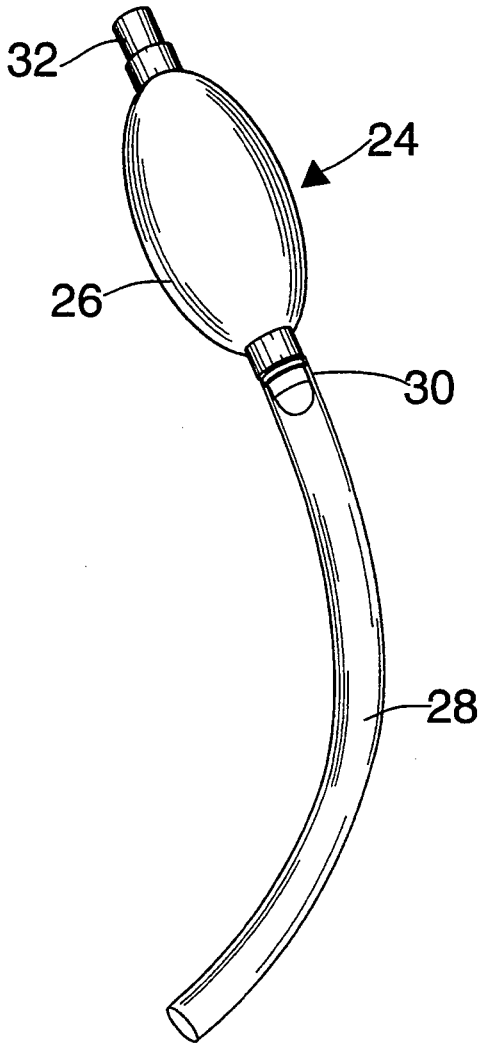
FIG. 2 is a top view of the associated pump of FIG. 1.

Now referring to FIG. 2, the tube 28 may be attached to the bulb pump 26 at the end 30, as shown for evacuating the nest 12 of FIG. 1 or may be attached at the other end 32 for pumping air into the nest 12.

Figure 3:
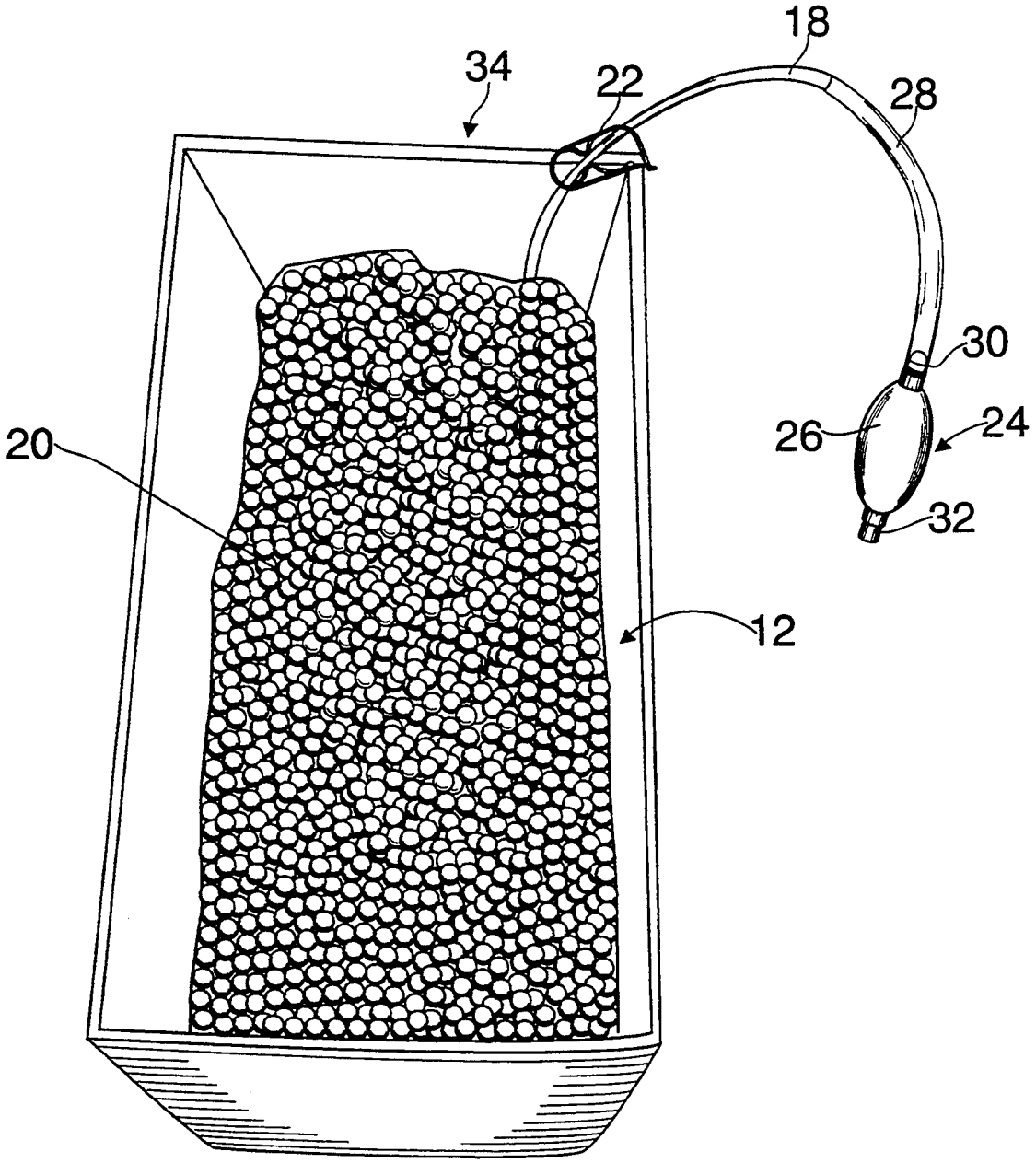
FIG. 3 is a perspective view of the packing nest of FIG. 1 with the pump of FIG. 1 attached in place in the bottom of a camera case.
Figure 4:
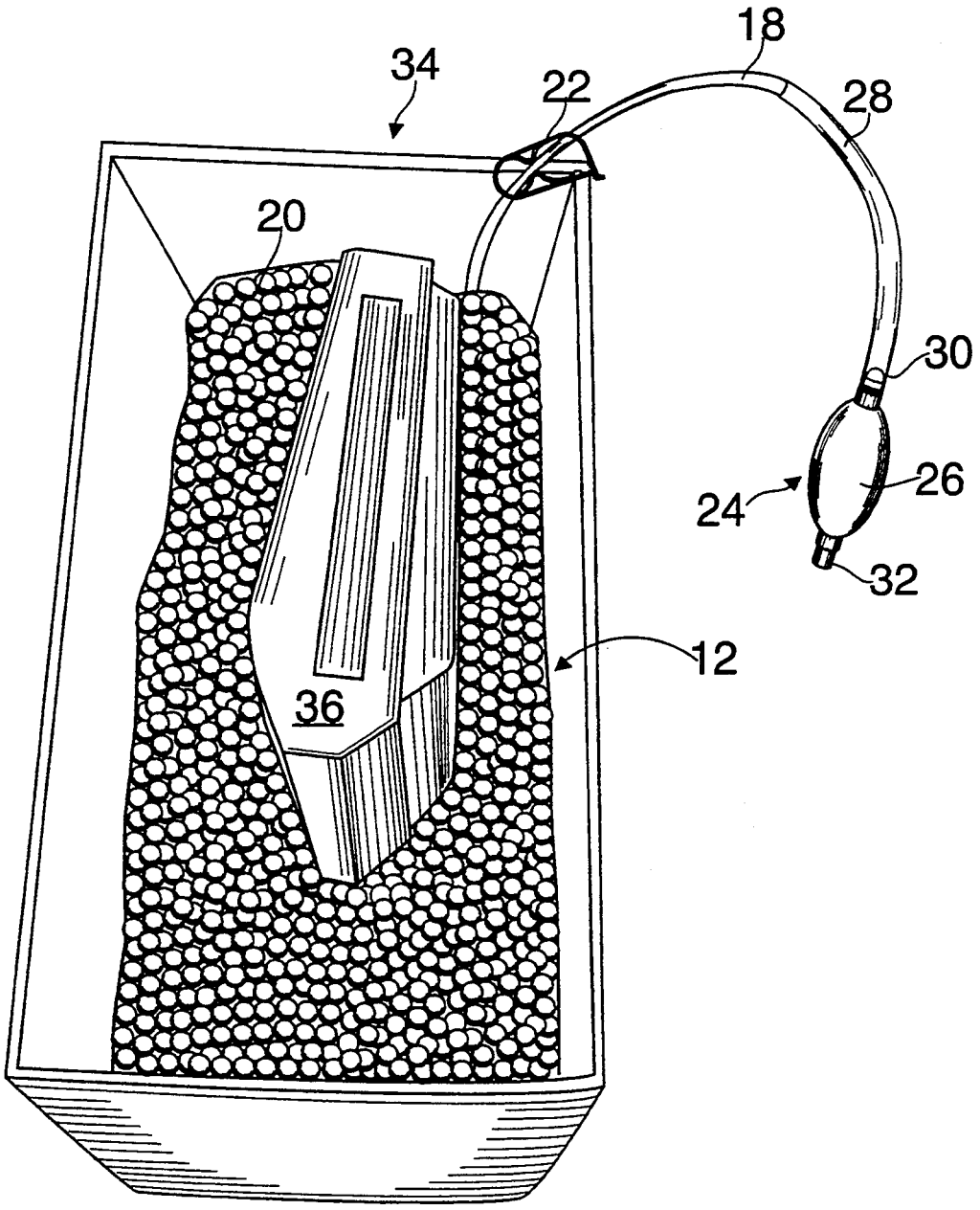
FIG. 4 is a perspective view similar to FIG. 3 showing a camera pushed down into the packing nest of FIG. 1 before it has been evacuated.

In FIG. 3, the nest 12 is shown placed in the bottom of a 5 inch by 12 inch camera case generally indicated at 34. The particles now fill the camera case to a depth of about 1 inch. The clamp 22 is open and the tube 28 is fitted over the tube 18.

Figure 5:
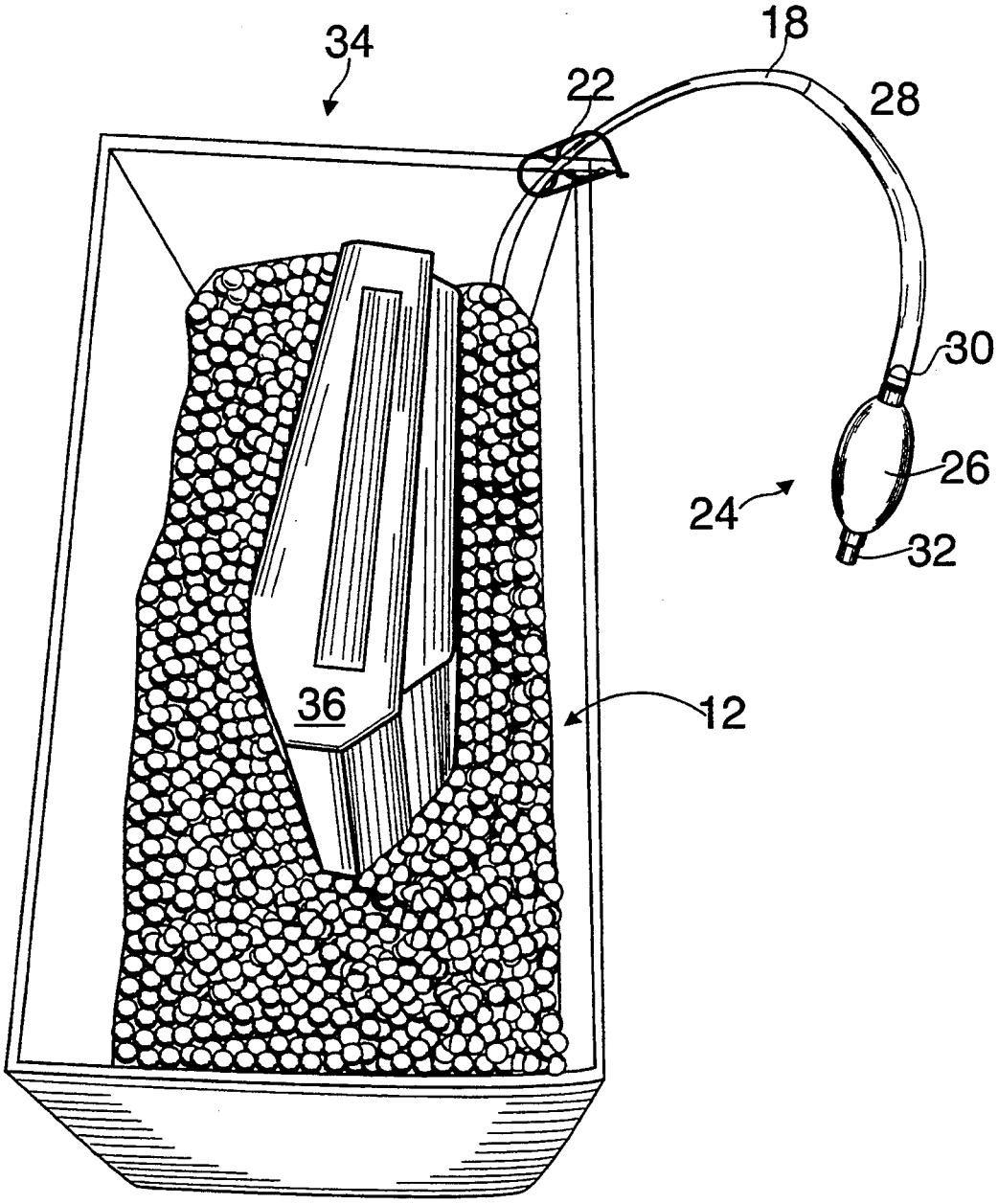
FIG. 5 is a perspective view similar to FIG. 4 after the packing nest has been evacuated.
Figure 6:
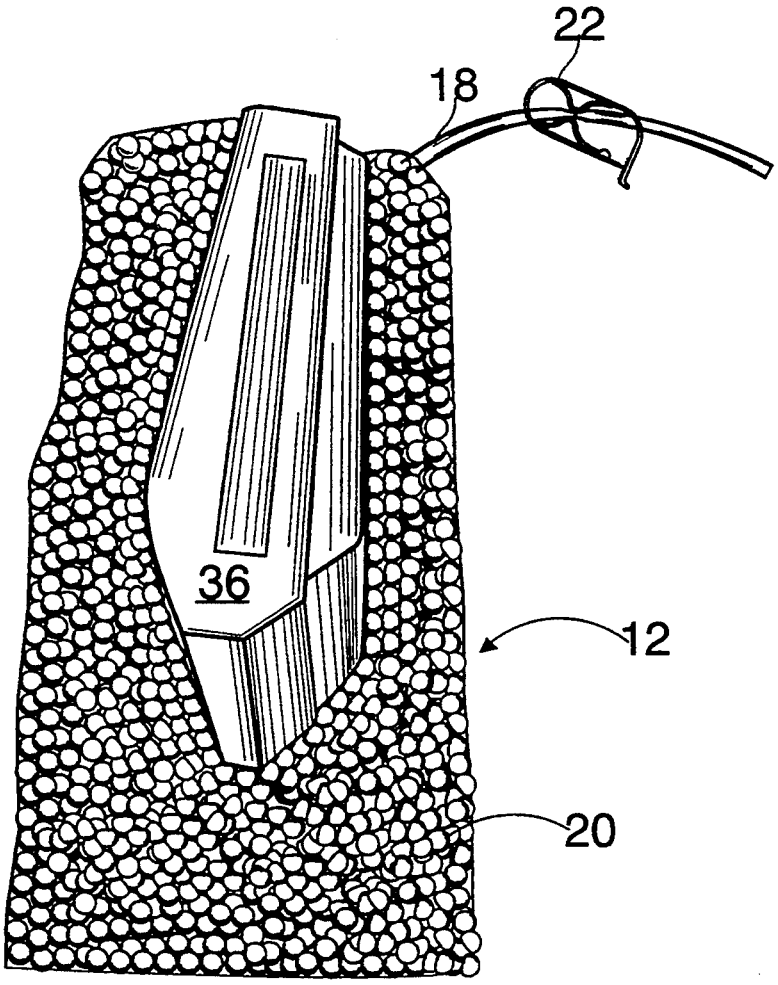
FIG. 6 is a perspective view of the camera and packing nest after evacuation, and sealing of the evacuated nest and after removal of the pump showing how the packing nest becomes rigid holding its conforming shape about the camera.

A camera, generally indicated at 36, is now pushed down into the nest 12 deforming the upper surface of the plastic film 14 and causing the particles 20 to heap up around the camera 36. The camera 36 may be pushed down until there is a single layer of particles 20 underneath it and no farther because of the action of the particles 20 within the nest 12. The pump 24 is then actuated to evacuate the nest 12 causing the particles 20 to rigidize in their conformation about the camera 36, as shown in FIG. 5. The camera 36 is held so tightly that by lifting the camera 36, the entire nest 12 may be pulled out of the camera case 34 still conforming to the camera 36, as shown in FIG. 6. Also as shown in FIG. 6, the clamp 22 has been closed, sealing off the tube 18 so that the nest 12 maintains its shape which it will do for many months until the clamp 22 is opened. When the user wishes to reconfigure the nest 12, he opens the clamp 22 allowing air into the nest 12 which then assumes its original limp shape.

Figure 7:
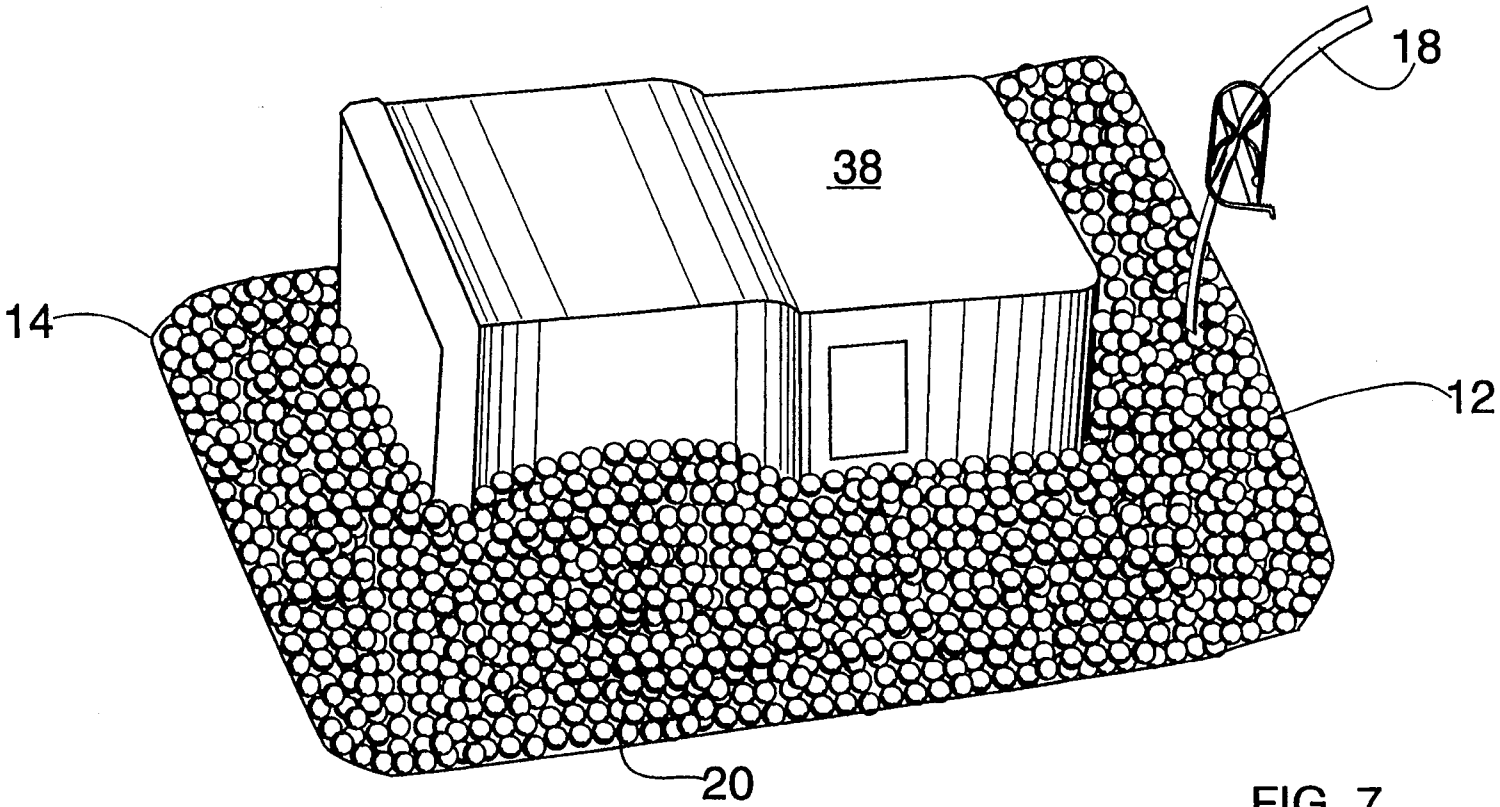
FIG. 7 is a perspective view of the packing nest of FIG. 1 after it has been evacuated and configured around a flash unit in a camera case smaller than that shown in FIGS. 3, 4, and 5.
Figure 8:
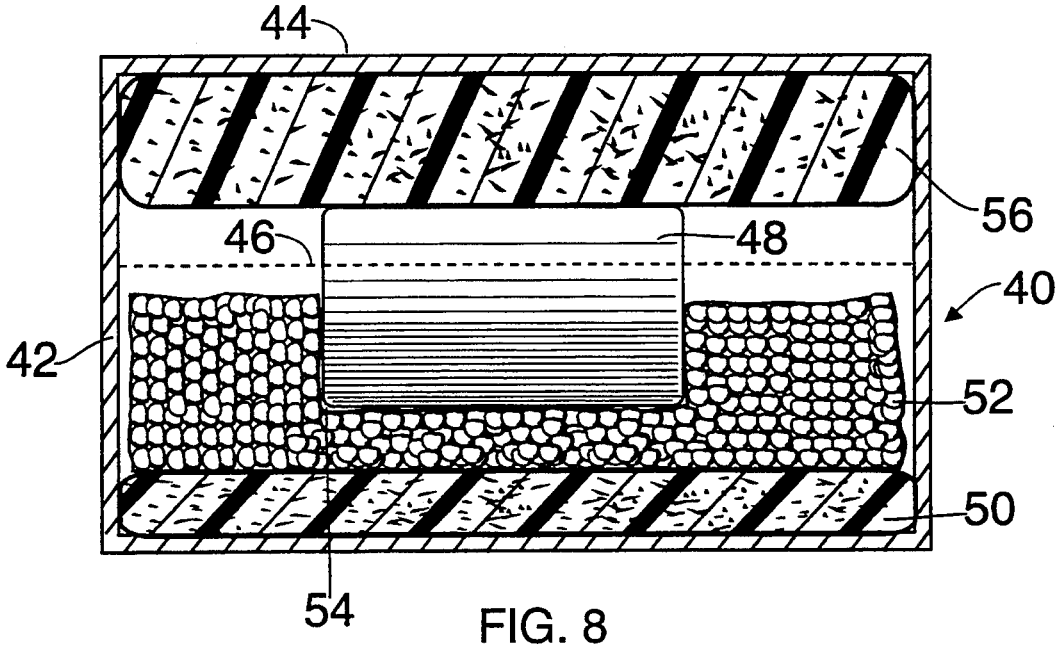
FIG. 8 is a cut-away diagrammatic view illustrating use of the packing nest of FIG. 1.

In FIG. 7, the nest 12 has been reconfigured in a smaller camera bag, about 6 inches by 10 inches, around a flash unit 38. FIG. 8 is a diagrammatic view of a package or case 40, according to the invention which comprises an outer casing 42. In the case of a camera bag or carton, the outer case 42 may terminate at a top 44. In the case of an attache case or the like, the termination between the top and the bottom portions may be along the dotted line indicated at 46. If the object 48 within the case 40 is to be subjected to rough handling, it is desirable that a lower pad 50 be included in the case 40. The pad, which is provided in most camera cases, may be of foam material or stuffed like a pillow. The rigidized nest 52, according to the invention, sits on the pad 50. The object 48 being nested in the conforming opening 54 in the nest 52. Optionally, another top pad 56 may be employed between the object 48 and the top surface 44 of the case 40. This may be a foam piece or may be inflatable as may be lower pad 50.

Figure 9:
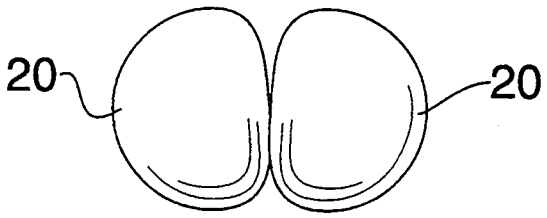
FIG. 9 is a perspective view of two particles deformed under the influence of the vacuum created in the packing nest of FIG. 1.

Referring to FIG. 9, the fact that the particles 20 are deformable under low pressure, aids in rigidizing the nest 52, shown in FIG. 8, without the use of high vacuum which would be hard to achieve in a consumer product and which would require the use-of very expensive barrier film to prevent leakage of air into the nest 52.

Key Parameters and Relationships

The vacuum-actuated conformal packing nest of the invention relates six key elements:

1. The object to be contained or nested;
2. A nest container in the form of a bag, pouch, or tray having a pliable upper surface to contain the filler material and to maintain a chosen reduced internal air pressure;
3. A quantity of particles, pellets, or beads as the shapable filler in the container;
4. The carrying case or other container in which the objects are to be nested;
5. The valves and fittings on the nest container for controlling the passage of air into and out of it and to seal the air path;
6. External means to pump air into and out of the nest container.

The choice of the design and components for Items 5 and 6 will vary widely based on the application, but their technical requirements are similar for most uses. That is to reduce the pressure in the bag to rigidize the nest, to seal the nest, and not to leak.

The objects to be nested are predetermined by the User. Item 4, the carrying case or container also is predetermined by the User as is the environment in which the packing nest must work.

Items 2 and 3 are the key elements of the invention and its practicality. Each has certain basic requirements and properties. In addition, for effective operation there are a number of relationships between the sizes and shapes of the nest containers and pellet fillers which are determined by the sizes and shapes of the objects to be contained and on the size and shape of the case or container. Successful application of these concepts is dependent on understanding and maintaining these relationships.

THE NEST CONTAINER

The material used for the nest container for the pellets must have a number of properties:

Non-Permeability: Since the objective is to keep air from leaking or seeping into it, its material and sealing methods must inhibit the passage of air for extended periods. The material chosen for the camera carrying case application is a special, heat-sealable, laminated plastic film produced by Dow Chemical Company under the Trademark SARANEX. This is a barrier film comprising 5 layers. The outer and middle layers are polyethylene and the other 2 layers are SARAN.

Flexibility and limpness, herein called pliability: i.e., the upper surface of the nest container must be conformable in relation to the external objects: A 2 mil "SARANEX 14" film is strong, tear resistant and wraps easily around the relatively complex contours of cameras and accessories. A heavier, stronger material would be needed for large, heavy objects.

The nominal size of the nest container in the bag configuration shown in the drawings must be larger than the floor-plan of the case or container. The total girth of the bag on each axis must be great enough to follow the depression contours of the object when nested to the depth desired. For the initial application, the open bag dimensions have ranged from 1.15 to 1.3 times the long dimension and from 1.25 to 1.5 times the short dimension of the desired case floor plan dimensions.

FILLER PELLETS

Shapes: The general ideal properties of the pellets or beads used as filler change as the loose filler is molded into the contours imposed by the external object and then are compacted into a firm mass nesting the objects as the air is removed from the nest container. In the loose, positioning state, the particles must slip and slide easily to find new positions. Rounded, i.e. acutely convex smooth shapes most readily satisfy this requirement. The pellets can be hard or soft, dry or slippery. Geometric forms such as flakes, cubes and other shapes with corners or interlocking textures do not perform well. Particle sizes and shapes such as sand or coffee grounds which can be readily packed and hold their form naturally without the addition of the vacuum film constraint are surprisingly difficult to shape by purely external manipulation of the object to be nested.

As the air is removed from the nest container, the ideal particle should lose its slippery, hard properties and stay where it is. This can be achieved if the particle, while smooth, has a high coefficient of friction or is deformable, so as to form minute interlocking impressions as it is squeezed into place. For example, rigid polyethylene balls would not be as desirable as soft rubber balls. Foam polystyrene balls work quite well since they are not slippery and are compressible.

The particles should be of very low density, i.e., have specific gravity very much less than that of water, so they will be easy to move up around the object to be nested.

Polystyrene beans, obtainable from Gold Metal Furniture Company, identified as bean refill 39009-0001X which are used to fill bean bag chairs work very well for this purpose and are shown in the drawings. These beans are generally spheroidal and are formed of a close cell gas filled foam with a smooth gas sealing outer surface, such that they pop when deformed and cut with a knife. These balls, not only have a high coefficient of friction, they also become statically charged and tend to stick together from static electricity when they interact with the different plastic (polyethylene) of the inner wall of the nest container.

Sizes: Pellets that are too large do not migrate easily and cannot nest properly to conform to the object contours. Pellets that are too small inhibit bulk migration during the seating process and can act as if pre-packed in an undesired shape. The best particle size is related also to the overall bag size, container size and object size.

It has been found that, for objects whose dimensions are in the range of 1" to 8" and nested to depths of 1" to 1.5", the best range of ball pellet sizes is from 0.06" to 0.25" diameter. This relationship can be approximated as particles whose projected area is equal to about 0.006 square inches per inch of object size range. For an object, say, 12"×36", the target diameters would range from 0.300" to 0.525". Intuitively this is reasonable, although smaller pellets may be desirable if the object has complex contours or detail. A range of sizes appears to work best.

Ping Pong balls are appropriate for objects 10–12 feet long.

CASE/NEST CONTAINER/PELLET VOLUME RELATIONSHIPS

The size of the bag is designed to permit the desired filling depth with the typical displacement due to the object load. The typical projected area of the object in plan view falls between 50% and 75% of the case area. A typical ratio of filled thickness outside and under the objects is from 4:1 to 6:1. This results in a typical pellet volume of approximately 40% of a volume equal to the internal plan view area times the boundary fill height desired.

APPROXIMATE BALL/PELLET SIZES

Minimum ball size: Relative to shortest width dimension (L) of objects.

Maximum ball size: Relative to largest longitudinal dimension (L).

Constant: 0.006 $in^2/in$ (L)

| L in inches | Diameter inches |
|---|---|
| 0.5 | 0.062 |
| 1 | 0.087 |
| 2 | 0.124 |
| 4 | 0.175 |
| 8 | 0.247 |
| 16 | 0.350 |
| 32 | 0.494 |
| 64 | 0.699 |
| 128 | 0.989 |

APPROXIMATE BAG SIZES: Includes .375/side for sealing

| Case Dimension in Inches | Bag Dimensions in Inches Min | Max |
|---|---|---|
| 5 | 7.0 | 7.8 |
| 6 | 8.3 | 9.2 |
| 7 | 9.5 | 10.5 |
| 8 | 10.8 | 12.0 |
| 9 | 11.1 | 12.5 |
| 10 | 12.3 | 13.8 |
| 12 | 14.5 | 16.4 |
| 13 | 15.7 | 17.7 |
| 14 | 16.8 | 19.0 |
| 15 | 18.0 | 20.3 |
| 16 | 19.2 | 21.6 |
| 17 | 20.3 | 22.9 |
| 18 | 21.5 | 24.2 |

APPROXIMATE FILL VOLUME: (Based on 1.25 inch fill height)

| Case Area in square inches | Volume in Cubic Inches Min | Max |
|---|---|---|
| 50 | 25.0 | 31.3 |
| 75 | 37.5 | 46.9 |
| 100 | 50.0 | 62.5 |
| 125 | 62.5 | 78.1 |
| 150 | 75.0 | 93.8 |
| 175 | 87.5 | 109.4 |
| 200 | 100.0 | 125.0 |
| 250 | 125.0 | 156.3 |
| 300 | 150.0 | 187.5 |

We have found that it is desirable to use a range of sizes of pellets so as to conform to both small and large objects. Thus, for the typical camera case application illustrated in FIGS. 1 through 7, the particles 20 range in size from about ⅛ to about 3/16 inches in diameter. Thus, the particle diameter can be related to the bags largest linear dimensions to range from about 0.0022 to about 0.0066 times the length of the bag 13.

The bag 13 is filled with the particles 20, such that when it is uniformly flattened, it is about ⅓ the height when the objects are nested in the camera bag. This means when the bag 13 is placed in the camera bag of the size for which it is designed, the particles rise to a height preferably about 1 inch, but this height may vary from about ½ inch to about 1.5 inches and still operate. The height of the beads when flattened uniformly in the bag 13 outside of a camera case ranges from about a quarter of an inch to three-quarters of an inch preferably about ½ inch.

It will thus be seen that the objects set forth above among those made apparent from the preceding description, are efficiently attained and, since certain changes may be made in the above article and in carrying out the above method without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claimed as new and desire to secure by Letters Patent is:

1. A package comprising:

A. a case comprising generally vertical side walls and a bottom attached thereto;

B. a vacuum actuated conformable packing nest located at the bottom of said case comprising:

a. a sealed container formed of material substantially impervious to air, at least the upper surface of said container being pliable and of dimensions substantially within the range of 1.15 to 1.5 times the dimensions of said bottom;

b. closed cell particles of a range of sizes contained within said container being deformable under a pressure of less than about ½ atmosphere;

c. a passageway for air into and out of said container; and d. means for closing said passageway whereby the upper surface of said container may be deformed by an object to surround the lower portion of said object with said particles in said container and said particles made rigid by evacuating said container through said passageway and closing said passageway to form a rigid packing nest conformed to the object.

2. A packing nest as defined in claim 1 wherein the outer surfaces of said particles are substantially entirely convex.

3. A package as defined in claim 1, and:

C. a lower resilient pad below said nest; and,

D. a upper resilient pad above said nest.

4. A package as defined in claim 3 wherein said particles have convex outer surfaces.

5. A package as defined in claim 3 wherein said particles are deformable.

6. A package as defined in claim 3 wherein said particles are closed cell, generally spheroidal, and deformable at least at about 0.2 atmospheres and range in size from about 0.062 to about 0.350 inches.

7. A package as defined in claim 1 wherein said particles are generally spheroidal closed cell foam plastic particles deformable under a pressure of at least about 0.2 atmospheres; and C. a tube forming the sole passage for air into an out of said container; and D. means for sealing said tube.

8. A package as defined in claim 1 wherein the inner surface of said plastic barrier film inside of said bag and the outer surfaces of said particles are different plastic materials.

9. A package as defined in claim 1 wherein said plastic particles form a depth of about 0.5 inches when said container is flattened.

10. A package as defined in claim 7 wherein said bag is rectangular and pillow shaped with outer dimensions less than about 20 inches by 15 inches and said particles vary in size from about 0.062 inches to about 0.350 inches.

11. A package as defined in claim 10 wherein said particles vary in diameter from about ⅛ inch to about 3/16 inches.

12. A package as defined in claim 7 wherein the inner surface of said plastic film in the outer surfaces of said particles are of different plastics; said particles range in size from a diameter of about ⅛ inch to a diameter of about 3/16 inch and are of varying sizes; said bag is rectangular and pillow shaped with outer dimensions less than about 20 inches by about 15 inches; and said plastic particles form a depth of about 0.5 inches when said bag is flattened.

13. A package as defined in claim 7 wherein the inner surface of the pliable barrier film forming said plastic bag is polyethylene and said particles are formed polystyrene.

14. A packing nest as defined in claim 1 wherein said particles contain at least one gas filled, sealed cell.

15. A packing nest as defined in claim 1 wherein said particles are closed cell foam plastic.

16. A packing nest as defined in claim 1 wherein said particles are of a density substantially less than that of water.

17. A packing nest as defined in claim 1 wherein said particles tend to stick together due to a static electric charge.

18. A packing nest as defined in claim 1 wherein said container has a thinnest dimension and two substantially larger dimensions and wherein the diameter of the particles is about 0.014 to 0.016 times the largest outer dimension of said container.

* * * * *